US005558437A

United States Patent [19]

Rode

[11] Patent Number: 5,558,437

[45] Date of Patent: Sep. 24, 1996

[54] DYNAMICALLY BALANCED ORBITAL SHAKER

[75] Inventor: Donald W. Rode, Marietta, Ohio

[73] Assignee: Forma Scientific, Inc., Marietta, Ohio

[21] Appl. No.: 444,658

[22] Filed: May 19, 1995

[51] Int. Cl.[6] ..... B01F 11/00

[52] U.S. Cl. ..... 366/208

[58] Field of Search ..... 366/110, 111, 366/114, 208, 209, 213, 216, 219, 128; 74/86, 573 R, 574, 603, 604

[56] References Cited

U.S. PATENT DOCUMENTS

| | | | |
|---|---|---|---|
| 2,255,799 | 9/1941 | Meinzer | 366/111 |
| 3,944,188 | 3/1976 | Parker et al. | 366/110 |
| 4,555,183 | 11/1985 | Thomas | 366/208 |
| 4,673,297 | 6/1987 | Siczek et al. . | |
| 5,052,812 | 10/1991 | Tannenbaum et al. | 366/209 |
| 5,060,151 | 10/1991 | Mikyska et al. . | |
| 5,167,448 | 12/1992 | Herold et al. . | |
| 5,372,425 | 12/1994 | Tannenbaum et al. | 366/209 X |

FOREIGN PATENT DOCUMENTS

| | | | |
|---|---|---|---|
| 1199840 | 7/1970 | United Kingdom | 366/209 |

*Primary Examiner*—Charles E. Cooley

[57] ABSTRACT

An orbital shaker having an upper horizontal orbiting platform and including a counterbalancing mechanism for stabilizing forces associated with the orbiting mass. The counterbalancing mechanism counteracts the moment created by the orbiting mass in the X-Z plane of the upper orbiting shaft by way of a lower counterweight rotating in phase, but spaced from the Z coordinate of the shaker load. The lower counterweight is positioned low relative to the driven, rotating shaft and is preferably incorporated into the drive sheave of the shaker. An upper counterweight, sized to counter the mass of the load, platform, etc., above it and the lower counterweight below it in the X-Y direction is connected to the driven shaft located out of phase with the load and the lower counterweight and between the load and lower counterweight in the Z direction.

7 Claims, 2 Drawing Sheets

DYNAMICALLY BALANCED ORBITAL SHAKER

FIELD OF THE INVENTION

The present invention generally relates to orbital shaker mechanisms and, more specifically, to a counterbalancing mechanism for reducing the instability caused generally by the orbital translation of the shaker platform and the load of flasks or other vessels on the platform.

BACKGROUND OF THE INVENTION

An orbital shaker mechanism is a mixing or stirring device used especially in scientific applications for mixing or stirring containers, such as beakers and flasks holding various liquids on a platform. Specifically, an orbital shaker translates a platform in a manner such that all points on the upper surface, in the X-Y plane, of the platform move in a circular path having a common radius. Generally, beakers, flasks, and other vessels are attached to the upper surface of the platform such that the liquid contained therein is swirled around the interior side walls of the vessel to increase mixing and increase interaction or exchange between the liquid and local gaseous environment. Conventionally, the mechanism which drives the platform in an orbital translation includes one or more vertical shafts driven by a motor with an offset or crank on the upper end of an uppermost shaft such that the axis of the upper shaft moves in a circle with a radius determined by the offset in the shaft, i.e., by the "crank throw". The upper shaft or shafts are connected to the underside of the platform via a bearing to disconnect the rotational movement between the upper shaft or shafts and the platform. On multishaft mechanisms, rotation of the platform is generally prevented by a four-bar-link arrangement of the shafts. On single shaft mechanisms, the rotation of the platform is generally prevented by connecting an additional linkage between the platform and base.

In operation, the mass of the shaft above the offset or crank throw, the platform with its mounting hardware and the load consisting of the filled flasks or vessels, and the clips or fasteners which hold the vessels to the platform all translate at the rotational velocity of the driven shaft in a circle with a radius equal to the crank throw. The mass of the liquid within the vessels translates at the shaft rotational velocity in a circle with a radius equal to the crank throw plus the distance from the center of the vessel to the center of mass of the liquid contained in the vessel.

The forces resulting from the total orbitally rotating mass can often cause motion of the base of the shaker which can superimpose additional motion components into the liquid in the vessels and lead to undesirable turbulence or splashing. These forces can also cause the base unit to move or "walk" along its support surface.

In prior attempts to "balance" these destabilizing forces and thereby reduce undesired motion of the shaker, various two plane counterbalancing techniques have been proposed. Typically, the counterbalance consists of a counterweight which rotates at the shaft rotational velocity while being located in an offset position opposite to the direction of the shaft offset or crank throw. The result of this is that, in the X-Y plane, the forces generated by the translation of the platform and load are countered or "cancelled" by the forces generated by the counterweight. Unfortunately, for the destabilizing forces to be fully cancelled, the counterweight would need to be located in the same plane, i.e., with respect to the Z axis, as the centroid of the combined mass of the platform and load. This, however, is not a practical or acceptable arrangement and, therefore, in a typical platform type shaker device the counterweight is mounted below the platform in a second plane.

The Z-axis disparity results in a rotating moment being applied to the shaft along the X-Z axis. This moment transfers force through shaft bearings to the base, resulting in each foot or base support member being alternately loaded and unloaded once per revolution in a phase relationship relative to the translation of the platform and load. For this reason, the force generated by the X-Z moment often still results in undesirable splashing or turbulence of the liquid within the vessels and "walking" of the shaker unit.

In view of the above-noted deficiencies, it would be desirable to provide a counterbalancing mechanism for an orbital shaker apparatus which greatly reduces the X-Z axis moment and therefore improves the stability of the apparatus and reduces splashing or turbulence of the liquid within the vessels during operation.

SUMMARY OF THE INVENTION

The primary objective of the present invention has therefore been to provide a counterbalancing mechanism which not only provides counterbalancing in an X-Y plane to counteract the unbalanced nature of the load created by the crank throw and which also provides counterbalancing of the moment thereby created in the X-Z plane of the load. Specifically, the present invention greatly reduces the X-Z moment and therefore improves the stability of the apparatus and reduces splashing and turbulence within the vessels on the shaker platform.

To this end, the present invention provides a counterbalancing mechanism which balances out the moment in the X-Z plane which contains the axis of the driven rotating shaft by way of a lower counterweight rotating in phase, i.e., on the same side of the rotating shaft with the load, but spaced from the Z coordinate of center of the load. On a typical shaker apparatus having a horizontal platform with a load on top, this is a lower position relative to the driven, rotating shaft. An upper counterweight, sized to counter the mass of the load, platform, etc., above it and the lower counterweight below it in the X-Y direction is connected to the driven shaft located out of phase with the load and the lower counterweight and between the load and lower counterweight in the Z direction.

In the preferred embodiment, the lower counterweight is advantageously incorporated into the drive sheave of the shaker. The size of this counterweight is typically determined by the standard load of flasks which are attached to the particular platform. Various drive sheaves may be provided with differently sized counterweights for balancing different loads. Where necessary for greater loads, a third counterweight, offset in the same direction as the crank throw and the lower counterweight may be mounted at a position below the upper or X-Y counterweight thereby adding to the mass of the counterweight in the drive sheave and adding additional counterbalancing for the greater load. Weight would also be added to the upper counterweight in this situation to account for the additional lower counterweight and the additional load.

As a result of the additional counterbalancing provided by the counterweight or counterweights which are located in phase with the load or in the direction of the crank throw but spaced from the Z coordinate of the load, the load is more completely stabilized and therefore a smoother stirring of the liquid within each flask or vessel is achieved and the shaker apparatus is more stable on its support surface.

These and other objectives and advantages of the present invention will become more readily apparent to those of ordinary skill upon review of the following detailed description of the preferred embodiments taken in conjunction with the accompanying drawings.

DETAILED DESCRIPTION OF THE PREFERRED EMBODIMENTS

Figure 1:
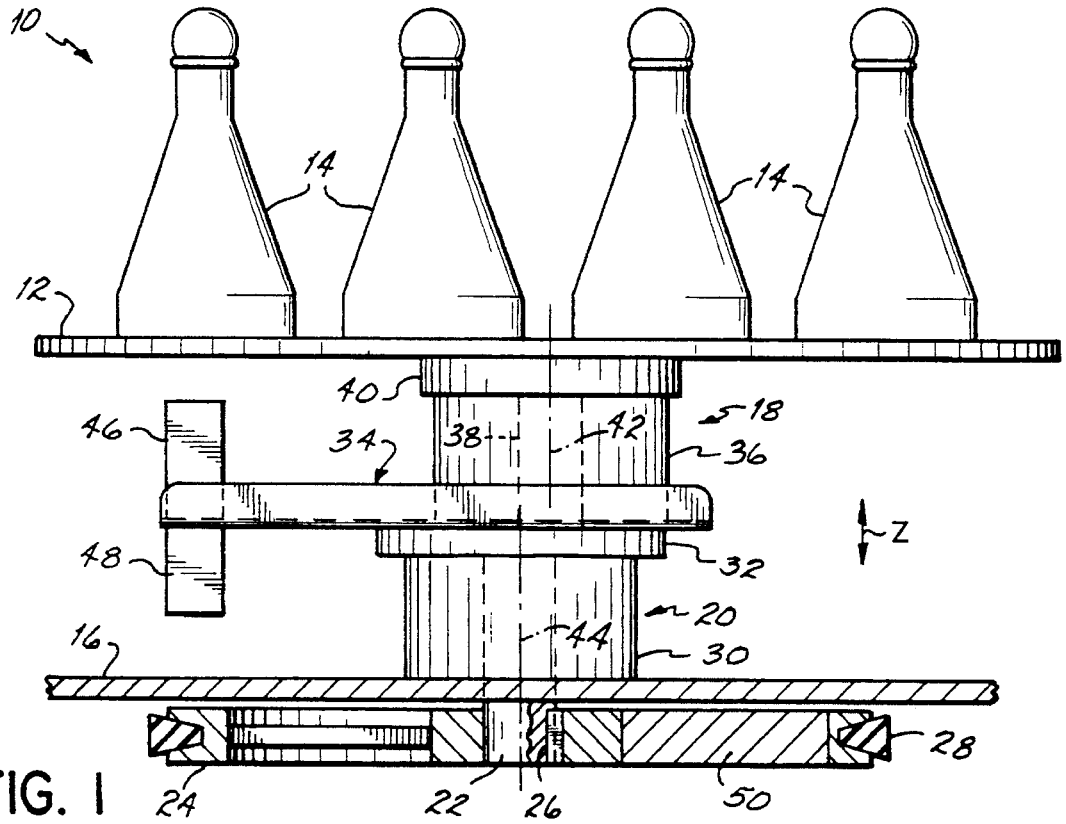
FIG. 1 is a schematic side elevational view of an orbital shaker apparatus with a lower portion thereof in cross-section to show the drive sheave in more detail.

Referring first to FIG. 1, a triple plane dynamically balanced orbital shaker 10 is shown and includes an orbitally rotating platform 12 which carries a plurality of flasks or other vessels 14 containing liquid to be stirred or shaken. A stationary, lower mounting plate 16 is provided for mounting the counterbalancing mechanism, drive shaft arrangement and platform 12 as will be described. Much of the structure of orbital shaker 10 has been deleted, such as the outer casing, support feet, controls and motor as these are conventional components of orbital shakers in general and as the present invention essentially deals with the unique counterbalancing technique of shaker 10.

Figure 2:
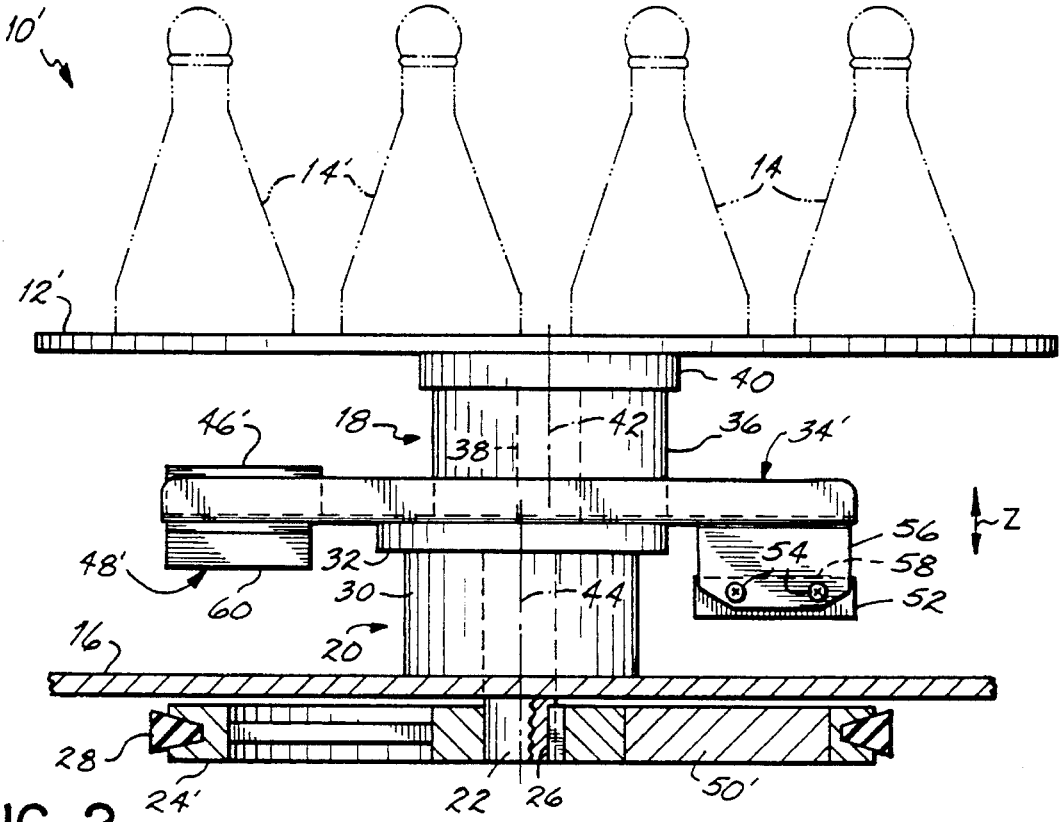
FIG. 2 is a schematic side elevational view of an orbital shaker apparatus similar to FIG. 1 but showing a greater amount of counterweight added to accommodate a greater load; and, FIG. 3 is an exploded, partially fragmented view showing the counterbalancing and drive mechanisms of the shaker illustrated in FIG. 2 in more detail.
Figure 3:
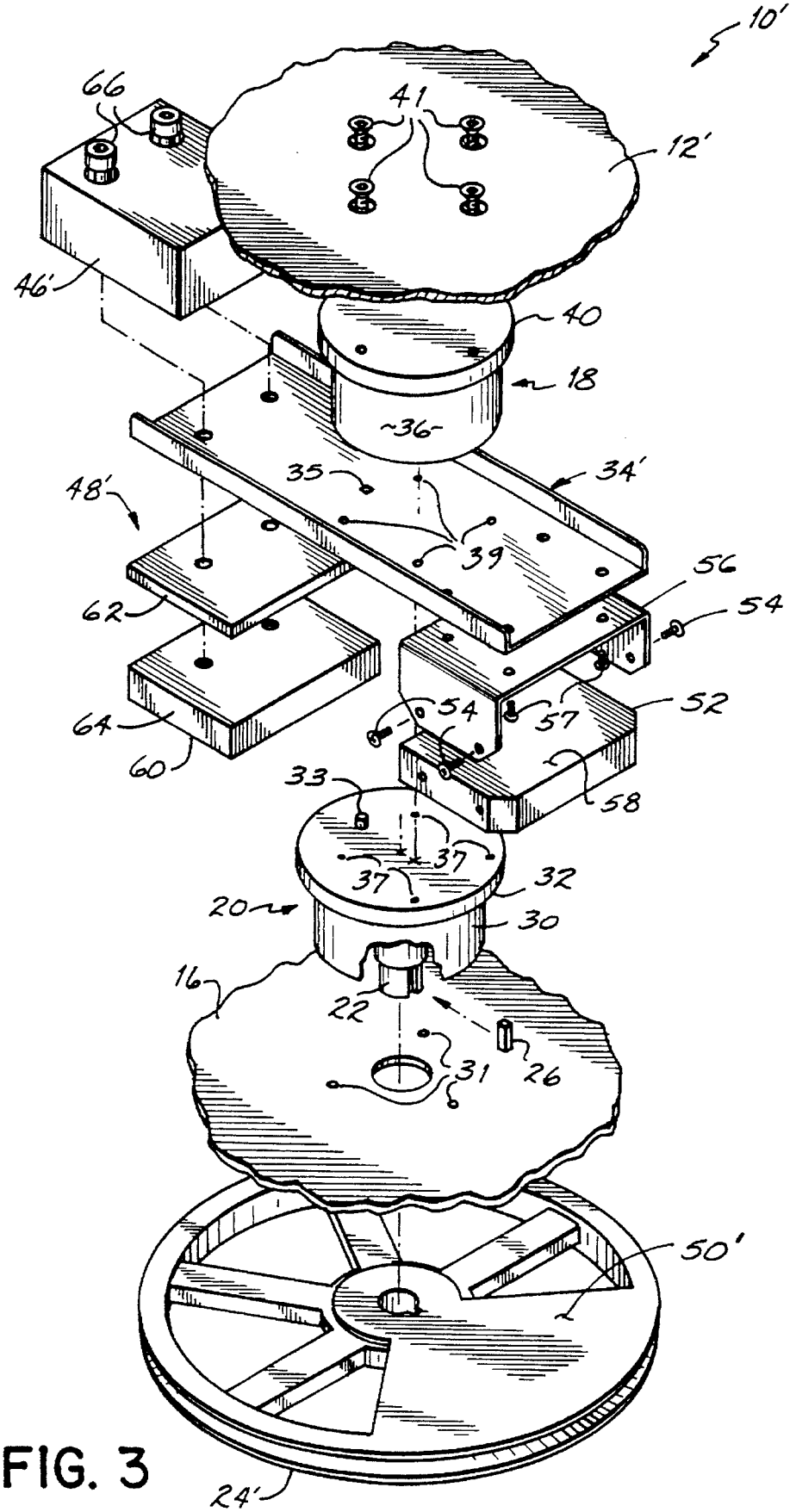

FIGS. 2 and 3 illustrate a second embodiment of a shaker 10' constructed in accordance with the present invention in which the counterbalancing weights are increased to account for an increased load of vessels 14' on platform 12'. The differences between the first embodiment shown in FIG. 1 and the second embodiment shown in FIGS. 2 and 3 will be described below, however, reference may be made to all of FIGS. 1–3 for the description of the drive mechanism, the components of which are essentially the same in both embodiments. In this regard, the orbital drive mechanism includes an upper shaft and bearing assembly 18 and a lower shaft and bearing assembly 20 mounted in offset relation, such as being offset by 0.5" in a horizontal "x" direction with respect to one another as will be described below. Lower shaft and bearing assembly 20 includes a lower shaft 22 which is rigidly secured within the center of a drive sheave 24 or 24' by way of a key 26. Drive sheave 24 receives a conventional drive belt 28 which may be connected to the output of an electric motor (not shown) also in a conventional manner.

As best shown in FIG. 3, lower shaft and bearing assembly 20 includes a lower bearing housing 30 which is rigidly secured to mounting plate 16 by suitable fasteners (not shown) extending through holes 31. Shaft 22 further includes an integral or rigidly connected upper flange portion 32 which rotates with shaft 22 as shaft 22 rotates within bearing housing 30. Flange portion 32 of lower shaft 22 includes an upwardly projecting locating knob 33 which is located within a hole 35 in a counterweight mounting bracket 34' to be described further below. Flange portion 32 of shaft 22 is rigidly secured to an upper bearing housing 36 of upper shaft and bearing assembly 18 with counterweight mounting bracket 34' held rigidly therebetween by suitable screw fasteners (not shown) extending through respective holes 37, 39 in flange portion 32 and mounting bracket 34'. Such fasteners fasten into holes (not shown) provided in bearing housing 36.

As shown in FIGS. 1 and 2, upper bearing housing 36 receives an upper shaft 38 also having an integral upper flange portion 40 which is rigidly secured to shaker platform 12 by screw fasteners 41 (FIG. 3). As will be understood best by a review of FIGS. 1 and 2, the purpose of upper bearing housing 36, or more accurately, the bearing therein, is to uncouple the rotational moment between shaker platform 12 and shafts 22 and 38. In a known manner, a four bar linkage mechanism (not shown) may be provided to inhibit rotation of platform 12 about upper central axis 42 of shaft 38 and platform 12. Thus, due to the offset between upper central axis 42 and lower central axis 44 of lower shaft 22, rotation of lower shaft 22 will rotate counterweight mounting bracket 34, bearing housing 36, shaft 38 with its flange portion 40 and platform 12 all about lower central axis 44 with platform 12 rotating in an orbital fashion but not rotating about its own central axis 42. Thus, all points on the upper surface of shaker platform 12 (i.e., in an X-Y plane) will move in a circular path having a radius equal to the distance between axis 42 and axis 44 (FIGS. I and 2).

With reference again to FIG. 1, in the first embodiment of orbital shaker 10, a pair of upper counterweights 46, 48 are mounted to an end of counterweight mounting bracket 34 at a location disposed in an opposite direction to the offset or crank throw of upper axis 42 with respect to lower axis 44. It will be appreciated that upper counterweights 46, 48 may simply comprise one single counterweight. Counterweights 46, 48 are used to counterbalance the destabilizing forces of the various orbitally rotating masses in the X-Y plane containing the centroid of the overall combined orbiting mass. In accordance with this invention, a lower counterweight 50, preferably incorporated directly into drive sheave 24, is mounted for rotation with shaft 22 at a location which is in the same direction as the offset of axis 42 with respect to axis 44. Lower counterweight 50 greatly reduces the rotating moment being applied to shaft 44 along the X-Z axis.

As mentioned above, FIGS. 2 and 3 illustrate a second embodiment which uses the same principles as the first embodiment except that a modified mounting bracket 34' has been provided and extends farther in the direction of the offset or crank throw between shafts 22 and 38 so as to provide a mounting location for an additional lower counterweight 52. Specifically, counterweight 52 is connected by fasteners 54 to a bracket 56 extending downwardly from counterweight mounting bracket 34'. As shown in FIG. 3, bracket 56 is connected to counterweight mounting bracket 34' by fasteners 57. Counterweight 52 is mounted at a vertical disposition which places its upper surface 58 no higher than the same height as lower surface 60 of counterweight 48'. This is because any portion of counterweight 52 disposed above lower surface 60 would, in essence, cancel out the "overlapping" portion of counterweight 48'.

Due to the additional load of flasks or vessels 14', such as additional numbers of flasks of the same size or use of larger flasks, the total counterweight used is increased with respect to the first embodiment. Counterweights 46' and 48' are heavier than counterweights 46, 48 of the first embodiment to account for both the increased load of flasks or other vessels 14' as well as the increased lower counterweight, comprised of weights 50' and 52' mounted in the direction of the crank throw or offset (i.e., the offset of axis 42 with respect to axis 44) for rotation with shaft 22. It will be appreciated that, in addition to the added counterweight 52, counterweight 50' incorporated into drive sheave 24' may be of increased size with respect to counterweight 50 of the first embodiment, depending on the total rotating mass. Also, counterweight 48' is actually comprised of two counterweights 62, 64 in the second embodiment with counterweights 46', 62 and 64 all being connected together and connected to counterweight mounting bracket 34' by screw fasteners 66 as shown in FIG. 3.

The method of calculating the values and locations for 15 counterweights 46, 48 and 50 in the first embodiment and counterweights 48', 50' and 52' may be accomplished in various ways using principles of mechanics. An example will be given below based on a load of filled flasks mounted on top of platform 12 of the first embodiment from which those of ordinary skill may understand the balancing principles of this invention which, for example, are also applicable to the second embodiment. As counterweight 50 is much more inflexible in terms of its mass and the position of its centroid, it is easier to solve for the required mass and centroid position of counterweights 46 and 48. For purposes of the calculations to follow, counterweights 46 and 48 will be referenced as a single counterweight "CWA" and counterweight 50 will be referenced as "CWB". Also, for purposes of a "z" axis reference from which calculations will be derived, the zero point or origin of the "z" axis, i.e. axis 44, is taken as the upper surface of flange portion 32.

The first step is to determine all of the orbiting masses of the shaker 10. This would include flasks 14, liquid within the flasks, clips or mounting hardware, platform 12 and upper assembly 18, for example, and the total of all masses may be referenced as "M". Each of the rigid orbiting masses "m" is multiplied by an "x" value equal to the crank offset, such as 0.5". The liquid within flasks 14, however, would have a larger value, such as 1.5", since the liquid within the flask is not rigid but moves to the outside of the flask during rotation. A total "x" force "$F_{x-m}$" is calculated by calculating the individual "(m)×(x)" values and summing them. The same procedure is followed to determine a total "z" force "$F_{z-m}$". That is, each of the masses "m" is multiplied by the distance of its particular centroid to the zero point or origin of the "z"-axis and these "(m)×(z)" values are summed up. After these initial calculations, the following calculations are made:

$$X_{bar}=F_{x-m}/M$$

$$Z_{bar}=F_{z-m}/M$$

Next, the moments of the centroids of the orbiting masses and of CWB are summed around z=0 by the following equations:

$$\text{Moment of orbiting masses}=I_m=(F_{x-m})\times(Z_{bar})$$

$$\text{Moment of CWB}=I_{CWB}=(F_{x-CWD})\times(Z_{low-CWD})$$

It will be appreciated that as CWB is incorporated into drive sheave 24, appropriate measurements may be taken to obtain values for $F_{x-CWD}$ and $Z_{low-CWD}$. $Z_{low-CWD}$ is the distance of the centroid of CWB from the origin of the z-axis. If practical, the $F_{x-CWD}$ value for CWB may be obtained in the same manner as in the above calculations.

Finally, the z-coordinate of the neutral point for M is calculated. The length of the moment arm "L" is obtained by adding $Z_{bar}$ and $Z_{low-CWD}$. The length L' of moment arm "L" below the origin of the z-axis is calculated by the following equation:

$$L'=(F_{x-m})\times(L)/(F_{x-CWD}+F_{x-m})$$

The z-coordinate of the neutral point may be found since L' equals $Z_{low-CWD}+Z_{neutral}$ and $Z_{neutral}$ therefore equals $L'-Z_{low-cwD}$.

Finally, the mass of CWA is calculated by adding $F_{x-m}$ to $F_{x-CWD}$ and dividing by the "x" or radial distance between the centroid of CWA and the z-axis, i.e., the distance of the centroid of combined weights 46, 48 to axis 44 along mounting bracket 34. This distance may be dictated by the size of shaker 10. After finding the mass required for CWA, it is mounted with its centroid disposed at $Z_{neutral}$.

Although preferred embodiments have been described in detail above, it will be appreciated that various modifications and substitutions may be made which fall within the spirit and scope of the invention. Therefore, it is not Applicant's intention to be bound by the details provided but only by the scope of the claims appended hereto.

What is claimed is:

1. An orbital shaker mechanism comprising:

a first shaft rotatable about a first axis and including a mounting portion;

a first bearing assembly receiving said first shaft;

a second shaft rotatable about a second axis offset from said first axis;

a second bearing assembly receiving said second shaft and having a bearing housing affixed to the mounting portion of said first shaft;

a counterweight mounting bracket mounted between the mounting portion of said first shaft and the bearing housing of said second bearing assembly, said counterweight mounting bracket extending both in a direction of the offset and in a direction opposite to the offset;

a platform connected to said second shaft at the offset such that rotation of said platform occurs in an orbital manner about said first axis;

a first counterweight fixed to said counterweight mounting bracket at a location disposed in a direction opposite to the offset; and, a second counterweight located farther from said platform than said first counterweight and mounted for rotation with said first shaft, said second counterweight being fixed to said counterweight mounting bracket at a location disposed in the direction of the offset.

2. The orbital shaker mechanism of claim 1 wherein said platform is a horizontal platform and the first counterweight is mounted at a higher location than the second counterweight.

3. The orbital shaker mechanism of claim 1 wherein the mounting portion of said first shaft is a flange extending from said first shaft, said flange being connected to both said counterweight mounting bracket and the bearing housing of said second bearing assembly.

4. An orbital shaker mechanism comprising:

a first shaft rotatable about a first axis and including a mounting portion;

a first bearing assembly receiving said first shaft;

a drive sheave fixed to said first shaft for rotating the first shaft about said first axis;

a second shaft rotatable about a second axis offset from said first axis;

a second bearing assembly receiving said second shaft and having a bearing housing fixed to the mounting portion of said first shaft;

a counterweight mounting bracket mounted between the mounting portion of said first shaft and the bearing housing of said second bearing assembly, said counterweight mounting bracket extending in a direction opposite to the offset;

a platform connected to said second shaft at the offset such that rotation of said platform occurs in an orbital manner about said first axis;

a first counterweight fixed to said counterweight mounting bracket at a location disposed in a direction opposite to the offset; and, a second counterweight incorporated into said drive sheave at a location disposed in the direction of the offset.

5. The orbital shaker mechanism of claim 4 wherein said platform is a horizontal platform and the first counterweight is mounted at a higher location than the second counterweight.

6. An orbital shaker mechanism comprising:

a first shaft rotatable about a first axis and including a mounting portion;

a first bearing assembly receiving said first shaft;

a drive sheave fixed to said first shaft for rotating the first shaft about said first axis:

a second shaft rotatable about a second axis offset from said first axis;

a second bearing assembly receiving said second shaft and having a bearing housing fixed to the mounting portion of said first shaft;

a counterweight mounting bracket mounted between the mounting portion of said first shaft and the bearing housing of said second bearing assembly, said counterweight mounting bracket extending both in a direction of the offset and in a direction opposite to the offset:

a platform connected to said second shaft at the offset such that rotation of said platform occurs in an orbital manner about said first axis;

a first counterweight fixed to said counterweight mounting bracket at a location disposed in a direction opposite to the offset;

a second counterweight fixed to said drive sheave at a location disposed in the direction of the offset; and, a third counterweight fixed to a portion of said mounting bracket extending in the direction of the offset and at a location farther from said platform than said first counterweight.

7. The orbital shaker mechanism of claim 6 wherein the mounting portion of said first shaft is a flange extending from said first shaft, said flange being connected to both said counterweight mounting bracket and the bearing housing of said second bearing assembly.

* * * * *